US006805363B2

(12) United States Patent
Hernandez

(10) Patent No.: US 6,805,363 B2
(45) Date of Patent: Oct. 19, 2004

(54) CONVERTIBLE SHOE

(75) Inventor: Homar Hernandez, Boca Raton, FL (US)

(73) Assignee: BBC International, Ltd., Boca Raton, FL (US)

( * ) Notice: Subject to any disclaimer, the term of this patent is extended or adjusted under 35 U.S.C. 154(b) by 39 days.

(21) Appl. No.: 10/225,042

(22) Filed: Aug. 20, 2002

(65) Prior Publication Data

US 2004/0036237 A1 Feb. 26, 2004

(51) Int. Cl.[7] ..... A63C 17/00

(52) U.S. Cl. ..... 280/11.19; 280/11.223; 280/11.3

(58) Field of Search ..... 280/11.19, 11.223, 280/11.27, 11.3, 7.1, 7.17; 36/115; 301/5.305, 5.306; 411/347, 348, 549, 21, 24, 25

(56) References Cited

U.S. PATENT DOCUMENTS

| | | | | | |
|---|---|---|---|---|---|
| 1,536,048 | A | | 5/1925 | Alastalo | |
| 1,572,142 | A | * | 2/1926 | Hood | 72/482.91 |
| 1,773,303 | A | | 8/1930 | Duff | |
| 1,784,330 | A | | 12/1930 | Bowers | |
| 2,583,786 | A | * | 1/1952 | Marzucco | 482/17 |
| 2,733,065 | A | | 1/1956 | Barkschat | 272/57 |
| 3,306,623 | A | | 2/1967 | Weitzner | 280/11.2 |
| 4,114,295 | A | | 9/1978 | Schaefer | 36/100 |
| 4,150,499 | A | | 4/1979 | Wang | 36/115 |
| 4,184,783 | A | * | 1/1980 | Hall | 403/157 |
| 4,679,862 | A | * | 7/1987 | Luo | 301/112 |
| 5,193,956 | A | * | 3/1993 | Duran | 411/33 |
| 5,224,961 | A | | 7/1993 | Liu | 301/111 |
| 5,314,241 | A | | 5/1994 | Cheng | 301/111 |
| 5,398,970 | A | | 3/1995 | Tucky | 280/841 |
| 5,441,286 | A | | 8/1995 | Pozzobon | |
| 5,494,340 | A | | 2/1996 | Cheng | 301/111 |
| 5,511,824 | A | | 4/1996 | Kim | 280/841 |
| 5,601,299 | A | * | 2/1997 | Yun et al. | 280/87.042 |
| 5,727,850 | A | * | 3/1998 | Masclet | 301/111.03 |
| 5,800,022 | A | | 9/1998 | Del Rosario | 301/5.3 |
| 5,988,656 | A | | 11/1999 | Krah | 280/11.27 |
| 6,120,039 | A | * | 9/2000 | Clementi | 280/11.19 |
| 6,132,006 | A | | 10/2000 | Post | 301/5.3 |
| 6,213,480 | B1 | * | 4/2001 | Rodriguez | 280/11.204 |
| 6,247,708 | B1 | * | 6/2001 | Hsu | 280/11.223 |
| 6,286,910 | B1 | * | 9/2001 | Kuhlman | 301/111.01 |
| 6,308,964 | B1 | * | 10/2001 | Chang | 280/11.19 |
| 6,328,318 | B1 | * | 12/2001 | Hsu | 280/11.223 |
| 6,334,621 | B1 | | 1/2002 | Chang | 280/11.3 |
| 6,350,095 | B1 | * | 2/2002 | Gross et al. | 411/298 |
| 6,354,609 | B1 | | 3/2002 | Chen et al. | 280/11.3 |
| 6,406,039 | B1 | * | 6/2002 | Chen | 280/11.27 |
| 6,488,289 | B2 | * | 12/2002 | Hsiao et al. | 280/11.208 |
| 6,607,198 | B2 | * | 8/2003 | Szendel | 280/11.27 |

* cited by examiner

*Primary Examiner*—Christopher P. Ellis
*Assistant Examiner*—Christopher Bottorff
(74) *Attorney, Agent, or Firm*—Holland & Knight LLP

(57) ABSTRACT

A shoe is provided which is convertible between a walking shoe and roller skate comprising a shoe upper connected to an outsole formed with an internal bore at both the heel area and arch area, each of which receive a hollow sleeve carrying a rod whose opposite ends protrude from the sides of the outsole. A first end of each rod mounts a wheel which is retained thereon by a fixed end cap, and the opposite, second end of each rod has opposed, radially outwardly extending locking pins which are received within bores formed in a locking cap operative to retain a second wheel on the second end of each rod.

6 Claims, 2 Drawing Sheets

CONVERTIBLE SHOE

FIELD OF THE INVENTION

This invention relates to shoes, and, more particularly, to a shoe which can be used as a roller skate and then converted for use as a walking shoe.

BACKGROUND OF THE INVENTION

Roller skates, and more recently in-line skates, have been commercially available for some time. While useful for skating, footwear of this type are not suitable to walk in, particularly over surfaces which are rough or uneven. As a result, unless one skates over a smooth surface and returns to where he or she started, it is necessary to carry a pair of walking shoes, sneakers or the like for use after the skating is completed.

This problem has been addressed in the past by the provision of a unit typically comprising an adjustable length frame formed in the general shape of a footprint having rollers mounted at the front end and the back end. The frame is affixed to the outsole of a shoe, such as a sneaker, usually by clamps, straps or a combination of the two. Although this arrangement has the advantage of allowing a sneaker or other article of footwear to convert to a roller skate, frames of this type have proven to be unsuitable except for use by small children. At higher speeds, and with increased side-to-side movement imposed by the skating of older children or adults, it has been found that the frame becomes unstable and tends to disengage from the shoe.

More recently, alternative designs have been proposed for a shoe which can be converted from a roller skate to a walking shoe and visa versa. One approach has been to form a shoe with a relatively thick outsole having a recess in both the heel area and the arch area of the shoe. One or more rollers are mounted within each of the recesses, which are movable between a retracted position and an extended position. In the retracted position, the rollers are completely contained within the recesses and the shoe can be used as a walking shoe. With the rollers in the extended position, the shoe functions as a roller skate. See, for example, U.S. Pat. No. 6,328,318 to Hsu; U.S. Pat. No. 6,308,964 to Chang; U.S. Pat. No. 6,247,708 to Hsu; U.S. Pat. No. 6,120,039 to Clementi and others.

As noted above, convertible shoes with retractable rollers require a comparatively thick outsole so that the recesses may be formed to receive the rollers. This adds expense and detracts from the comfort of the shoe when used as a walking shoe instead of a roller skate. Additionally, relatively complicated mechanisms are required to extend and retract the rollers with respect to the recesses which adds cost, both in terms of parts and labor for assembly.

Another approach utilized to convert a shoe for use as both a walking shoe and roller skate is disclosed, for example in U.S. Pat. No. 6,354,609 to Chen et al and U.S. Pat. No. 5,511,824 to Kim. Shoes of this type generally comprise a shoe upper connected to an outsole which is formed with an internal bore both in the heel area and arch area of the shoe. A rod or shaft is inserted through each of the bores such that its ends protrude from the sides of the outsole. Each rod mounts a first wheel at one end and a second wheel at the opposite end to convert the shoe for use as a roller skate. The mounting structure for the wheels on at least one side of the outsole is such that it can be disengaged to permit the wheels and rod to be removed, allowing the shoe to function as a walking shoe.

Although simpler in construction and cheaper to manufacture and assemble than the convertible shoes with extendable and retractable rollers, shoes of the type described in the Chen and Kim patents noted above have limitations. In the U.S. Pat. No. 5,511,824 Kim patent, a relatively complex bushing and pushpin arrangement is employed to secure a wheel to one end of the rod or shaft. A simpler, less expensive design is shown in the Chen Patent U.S. Pat. No. 6,354,609, which includes a pin and pivot member combination to secure the wheels on one side of the rod or shaft, but this construction can come apart and allow the wheel to disengage the shaft.

SUMMARY OF THE INVENTION

It is therefore among the objectives of this invention to provide a shoe which can be converted for use as a walking shoe and a roller skate which is simple in construction, inexpensive to manufacture and assemble and which provides protection against disengagement of the wheels when used as a roller skate.

These objectives are accomplished in a shoe which is convertible between a walking shoe and a roller skate comprising a shoe upper connected to an outsole formed with an internal bore at both the heel area and arch area, each of which receive a hollow sleeve carrying a rod whose opposite ends protrude from the sides of the outsole. A first end of each rod mounts a wheel which is retained thereon by a fixed end cap, and the opposite, second end of each rod has opposed, radially outwardly extending locking pins which are received within bores formed in a locking cap. The locking cap is effective to retain a second wheel on the second end of each rod.

In the presently preferred embodiment, the second end of each of the rods is formed with opposed bores which align with one another. Locking pins are inserted within the interior of the second end of each rod, in alignment with the opposed bores, and are connected to one another by a spring. In order to assemble a wheel on the second end of a rod, the locking pins are initially moved to a retracted position in which the spring is compressed and both locking pins are located entirely within the interior of the second end of the rod. With the locking pins remaining in the retracted position, a wheel is placed over the second end of the rod, and then a locking cap is located over the bores in the second end. Preferably, the locking cap is formed with a number of circumferentially spaced, radially extending bores, each dimensioned to receive one of the pins. When the locking cap is in alignment with the locking pins, the locking pins move to the extended position under the influence of the spring and each protrude into one of the radial bores of the locking cap to maintain it in place on the rod.

One advantage of the wheel locking arrangement of this invention is that a "back-up" structure is provided to resist disengagement of the wheel from the second end of the rod. The wheel is formed with a through bore having a diameter slightly greater than that of the rod. In turn, the diameter of the locking cap is greater than that of the through bore so that it engages the hub or side of the wheel to prevent it from sliding off of the rod. The locking cap therefore comprises the primary means of retaining the wheel on the second end of the rod. Preferably, the length dimension of the two locking pins, measured from the tip of one pin to the tip of the other in their extended position, is also greater than the diameter of the through bore of the wheel. Consequently, even if the locking cap should become disengaged from the locking pins and removed from the second end of the rod, the ends of the locking pins would engage the side or hub of the wheel to retain it in place until the locking cap could be replaced. The locking pins therefore provide a back-up or secondary retention means for the wheel.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 1:
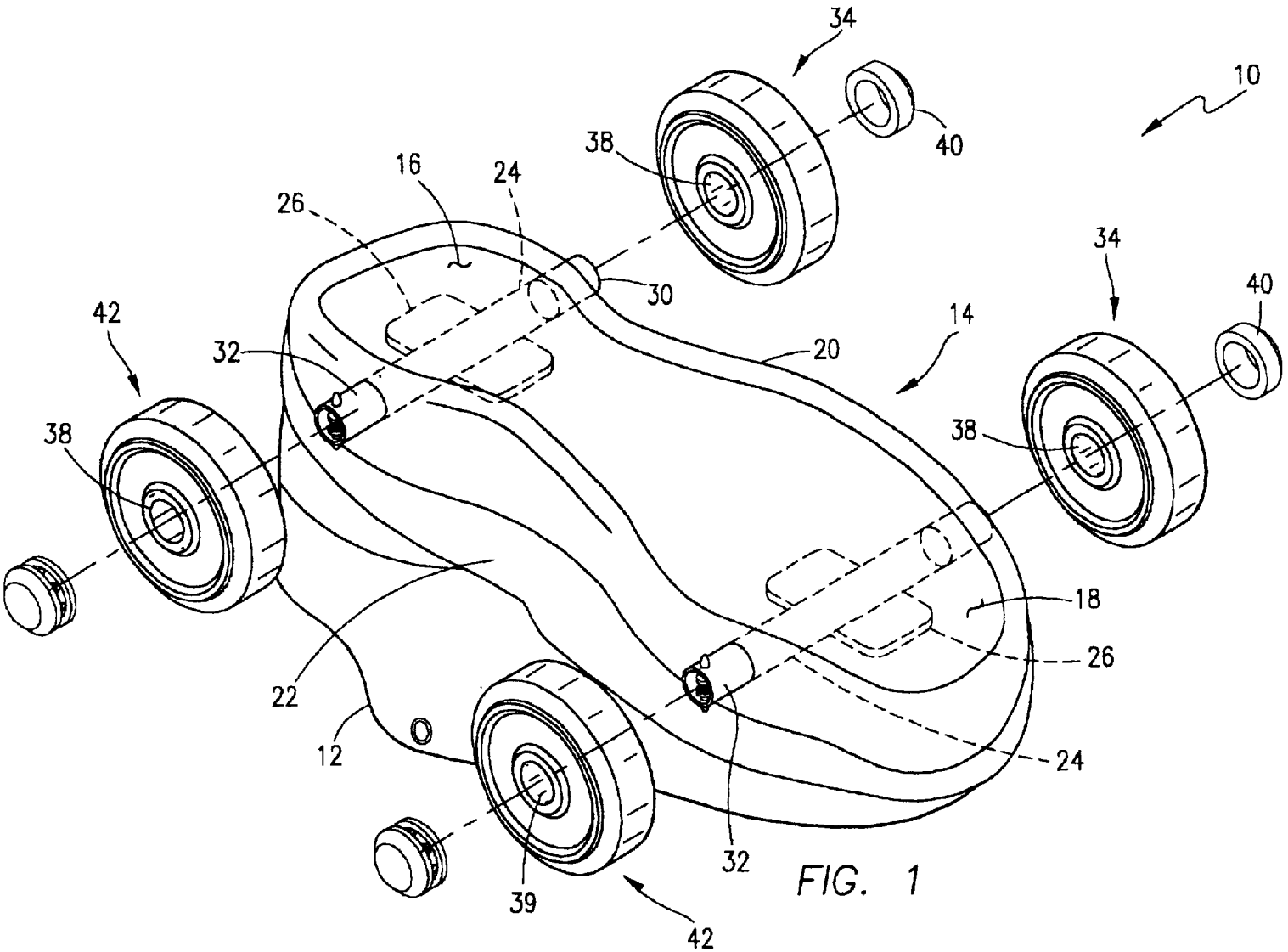
FIG. 1 is a disassembled, perspective view of the bottom of the convertible shoe of this invention.

Referring now to the drawings, a convertible shoe 10 is illustrated including a standard shoe upper 12 connected to an outsole 14 having a heel area 16, an arch area 18 and opposed sides 20 and 22. An internal bore is formed in the outsole 14 at its heel area 16, and a second internal bore is formed in the arch area 18 of the outsole 14. Each of these internal bores receives a hollow sleeve 24, shown in phantom lines in FIG. 1, which is retained in position within a respective bore by a separate mounting bracket 26 embedded in the outsole 14. The hollow sleeves 24, in turn, receive a shaft or rod 28 having a first end 30 which protrudes from the side 20 of outsole 14 and a second end 32 protruding from the opposite side 22 of outsole 14.

Figure 2:
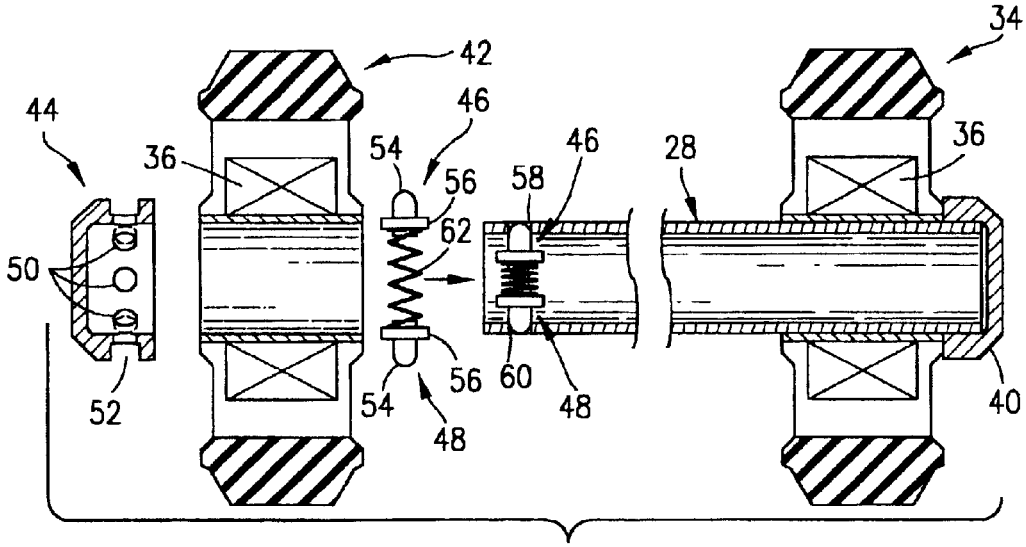
FIG. 2 is an elevational view, in partial cross section, depicting the end cap, locking cap and locking pins in relation to the wheels and rod.

As best seen in the right hand side of both FIGS. 1 and 2, a pair of first wheels 34 each having an internal bearing 36 and a through bore 38 is slid onto the protruding first end 30 of a respective rod 28 at the heel area 16 and arch area 18 of the outsole 14. Each of the first wheels 34 is retained on its respective rod 28 by an end cap 40, which is essentially permanently affixed to rod 28.

In the presently preferred embodiment, a pair of second wheels 42 are mounted to the second end 32 of one of the rods 28 by the combination of a locking cap 44 and opposed locking pins 46 and 48. The second wheels 42 are identical to the first wheels 34, including the same internal bearing 36 and through bore 38. The locking cap 44 is formed with a number of circumferentially spaced bores 50 which terminate within a radially inwardly extending groove 52 having a depth measured from the outer periphery of the locking cap 44 toward its center. The locking pins 46 and 48 are identical, and include a tip 54 at one end and a seat 56 at the opposite end. The second end 32 of each rod 28 is formed with a pair of opposed, aligning bores 58 and 60, one of which receives the locking pin 46 and the other the locking pin 48 such that the seats 56 of the locking pins 46, 48 are located within the interior of the rods 28. As shown in FIGS., a spring 62 is connected to and extends between the seats 56 of the locking pins 46 and 48.

Figure 3:
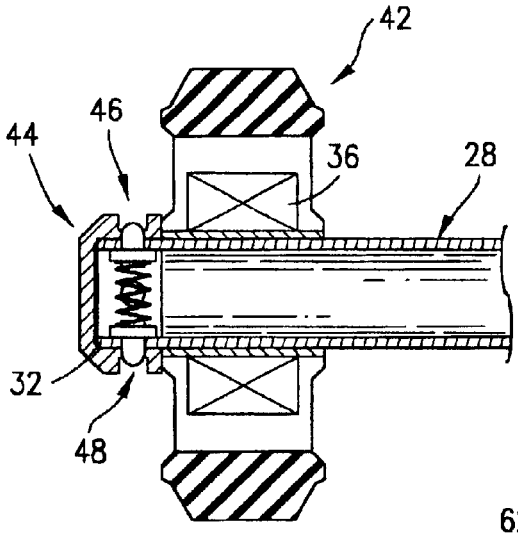
FIG. 3 is a view of a portion of FIG. 2, except with the locking cap and locking pins in the assembled position.

In order to mount a second wheel 42 to the second end 32 of one of the rods 28, the locking pins 46 and 48 are first moved toward one another, against the force of the spring 62, to the retracted position shown at the center of FIG. 2. In this position, the tip 54 of each locking pin 46, 48 is substantially flush with the outer surface of the rod 28, allowing it to be inserted within the through bore 38 of the second wheel 42. Once the locking pins 46 and 48 clear the outer side of the second wheel 42, and with them still in the retracted position, the locking cap 44 is then placed in a location such that two of its bores 50 align with the opposed bores 58 and 60 formed in the second end 32 of the rod 28. The locking pins 46 and 48 are then released, allowing them to move to an extended position depicted in FIG. 3, wherein each locking pin 46 and 48 enters one of the bores 50 in the locking cap 44 to secure it to the rod 28. The depth of the groove 52 in the locking cap 44 is sized so that with the locking pins 46 and 48 in the extended position the tip 54 of each locking pin 46, 48 does not extend beyond the outer periphery of the locking cap 44. See also FIG. 3.

Figure 4:
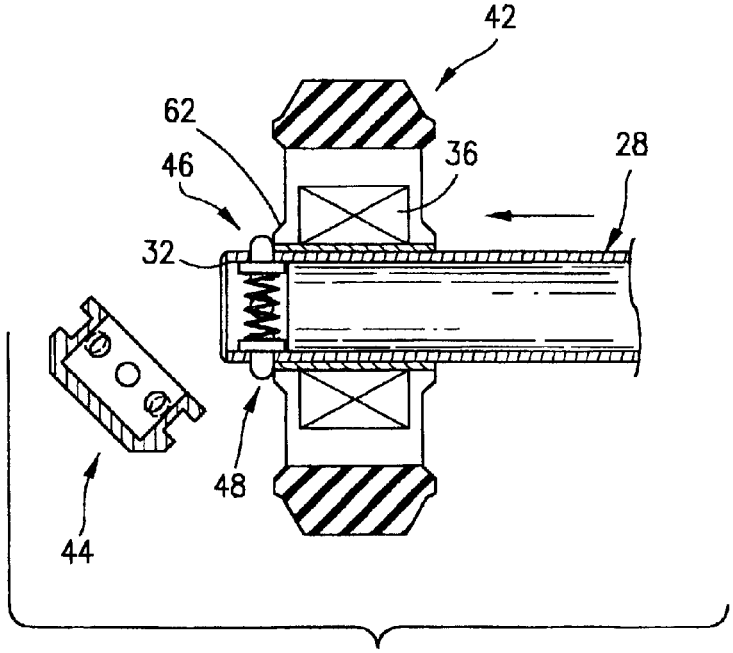
FIG. 4 is a view similar to FIG. 3 with the locking cap disengaged and the wheel retained on the rod by the locking pins.

One advantage of the locking structure for the second wheels 42 is that the locking pins 46 and 48 provide a secondary or "back-up" means for retaining each second wheel 42 on the rod 28. As best seen in FIG. 4, in the event the locking cap 44 is somehow separated from the end 32 of rod 28, the locking pins 46 and 48 each protrude a sufficient distance from the opposed bores 58, 60 in the rod 28 to engage the outer side or hub 62 of a second wheel 42. In other words, the total length of the two locking pins 46 and 48, measured from one tip 54 to the opposite tip 54 when in the extended position, is greater than the diameter of the through bore 38 of each second wheel 42. This ensures that the second wheel 42 remains in place on the end 32 of rod 28, even if the locking cap 44 does not.

The wheels 40 and 42, and rods 28, are removed from the outsole 14 by essentially reversing the assembly operation noted above. The locking pins 46 and 48 are moved to the retracted position, allowing each locking cap 44 to be removed and the second wheels 42 slid off of the rod ends 32. With the locking pins 46 and 48 remaining in the retracted position, each rod 28 is then pulled out of the sleeve 24 at the heel area 16 or arch area 18 of the outsole 14 taking with them the first wheels 34 and end caps 40. The shoe 10 is then ready for use as a walking shoe.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A convertible shoe adapted for walking and skating comprising:

a shoe upper connected to an outsole having a heel portion, an arch portion and opposed sides, said outsole being formed with a first bore in the area of said heel portion and a second bore in the area of said arch portion;

a first rod mounted within said first bore and a second rod mounted within said second bore, each of said first and second rods including:

(i) a first end which protrudes from one side of said outsole;

(ii) a second end which protrudes from the opposite side of said outsole, said second end being formed with opposed bores;

(iii) a first pin extending within one of said opposed bores in said second end of said rod, and a second pin extending within the other of said opposed bores, said first and second pins being movable between a retracted position within the interior of said rod and an extended position in which said first and second pins protrude from said respective, opposed bores;

a first wheel located on said first end of each of said first and second rods, and an end cap affixed to said first end of said first and second rods to retain said first wheel in place;

a second wheel located on said second end of each of said first and second rods so that each of said second wheels is positioned between one side of said outsole and said first and second pins;

a locking cap having at least two circumferentially spaced bores, said locking cap being fitted onto said second end of each of said first and second rods in position to receive one of said first and second pins within one of said spaced bores thereof, said locking cap thereby securing each of said second wheels onto said second end of one of said first and second rods.

2. The shoe of claim 1 in which a spring is connected between said first pin and said second pin within said second end of each of said first and second rods, said spring being compressed in moving said first and second pins to said retracted position and extended in moving said first and second pins to said extended position.

3. The shoe of claim 1 in which said first and second pins are moved to said retracted position while said second wheel and said locking cap are fitted onto said second end of said first and second rods, said first and second pins thereafter being moved to said extended position for insertion within said at least two spaced bores of said locking cap.

4. The shoe of claim 1 in which each of said locking caps is formed with a circumferential groove within which said at least two spaced bores are formed, said groove having a depth such that said first and second pins do not protrude beyond said groove when inserted within said at least two spaced bores.

5. The shoe of claim 2 in which each of said first and second pins is formed within a tip at one end and a seat at the opposite end, said tip extending through one of said at least two bores in said second end of said first or second rods, said spring being connected between said seats of said first and second pins.

6. The shoe of claim 5 in which each of said second wheels is formed with a through bore to receive one of said first and second rods, said first and second pins when in said extended position within said at least two opposed bores in said second end of said first and second rods defining a length dimension from said tip of said first pin to said tip of said second pin which is greater than the diameter of said through bore in said second wheels.

* * * * *